US008691485B2

(12) United States Patent
Asarese et al.

(10) Patent No.: US 8,691,485 B2
(45) Date of Patent: Apr. 8, 2014

(54) TONER COMPOSITIONS

(75) Inventors: Daniel W. Asarese, Honeoye Falls, NY (US); Grazyna E. Kmiecik-Lawrynowicz, Fairport, NY (US); Samir Kumar, Pittsford, NY (US); Maura A. Sweeney, Irondequoit, NY (US); Siddhesh N. Pawar, Blacksburg, VA (US); Robert D. Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 401 days.

(21) Appl. No.: 12/575,718

(22) Filed: Oct. 8, 2009

(65) Prior Publication Data

US 2011/0086304 A1 Apr. 14, 2011

(51) Int. Cl.
*G03G 9/00* (2006.01)

(52) U.S. Cl.
USPC ..... 430/108.8; 430/107.1; 430/108.4; 430/109.1

(58) Field of Classification Search
USPC ..... 430/108.8, 108.4, 107.1, 109.1
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,983,045 | A | 9/1976 | Jugle et al. |
| 4,265,990 | A | 5/1981 | Stolka et al. |
| 4,298,672 | A | 11/1981 | Lu |
| 4,338,390 | A | 7/1982 | Lu |
| 4,563,408 | A | 1/1986 | Lin et al. |
| 4,584,253 | A | 4/1986 | Lin et al. |
| 4,935,326 | A | 6/1990 | Creatura et al. |
| 4,937,166 | A | 6/1990 | Creatura et al. |
| 5,227,460 | A | 7/1993 | Mahabadi et al. |
| 5,346,797 | A | 9/1994 | Kmiecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,190,815 | B1 | 2/2001 | Ciccarelli et al. |
| 6,923,984 | B1 * | 8/2005 | Remon ..... 424/464 |
| 7,312,011 | B2 * | 12/2007 | Patel et al. ..... 430/109.4 |
| 7,390,606 | B2 | 6/2008 | Patel et al. |
| 2006/0046176 | A1 | 3/2006 | Hidaka |
| 2007/0087280 | A1 * | 4/2007 | Patel et al. ..... 430/110.2 |
| 2007/0190441 | A1 | 8/2007 | Sweeney et al. |
| 2007/0207400 | A1 | 9/2007 | Ahuja et al. |
| 2007/0248907 | A1 | 10/2007 | Van Denend et al. |
| 2008/0038654 | A1 | 2/2008 | Yamazaki et al. |
| 2008/0044754 | A1 | 2/2008 | Marcello et al. |
| 2008/0153025 | A1 * | 6/2008 | Lai et al. ..... 430/109.3 |
| 2008/0247788 | A1 * | 10/2008 | Ayaki et al. ..... 399/321 |
| 2011/0091801 | A1 | 4/2011 | Mang et al. |

FOREIGN PATENT DOCUMENTS

WO 2008/157436 A1 * 12/2008

* cited by examiner

*Primary Examiner* — Thorl Chea
(74) *Attorney, Agent, or Firm* — MDIP LLC

(57) ABSTRACT

The present disclosure provides toners and methods for their production. In embodiments, the toner may include a core/shell configuration, with a non-crosslinked resin and a crosslinked resin in the core, with a second non-crosslinked resin in the shell, pigment/pigments and a wax possessing both branched and linear carbons.

16 Claims, 4 Drawing Sheets

TONER COMPOSITIONS

BACKGROUND

The present disclosure relates to toners and processes useful in providing toners suitable for electrostatographic apparatuses, including xerographic apparatuses such as digital, image-on-image, and similar apparatuses.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Some high gloss EA toners use resins possessing a core-shell configuration, with a lower glass transition temperature (Tg) resin in the core and a higher Tg resin in the shell. Such toners may include waxes and may be produced with aggregating agents based on aluminum. Processes for producing such toners may utilize sequestering agents to remove aluminum ions and lower ionic cross-linking, thereby increasing the gloss. One issue with these toners is they may be prone to blocking issues and may have many wax protrusions on the surface.

Improved methods for producing toner, which decrease the production time and permit excellent control of the charging of toner particles, remain desirable.

SUMMARY

The present disclosure provides toner formulations which may be suitable, in embodiments, for Single Component Development (SCD) monochrome printers. Toners of the present disclosure may possess improved hot offset and fusing ratio performance and higher optical density of the printed images. Processes for producing such toners are also provided.

In embodiments, a toner of the present disclosure may include a core and a shell, wherein the core includes a resin including a first non-crosslinked polymer in combination with a crosslinked polymer, at least one modified paraffin wax possessing branched carbons in combination with linear carbons, and an optional colorant, wherein the shell includes a second non-crosslinked polymer present in an amount of from about 20 percent by weight of the toner to about 40 percent by weight of the toner, and wherein the branched carbons of the at least one modified paraffin wax are present in an amount of from about 1% to about 20% of the wax and have a number average molecular weight of from about 520 to about 600, and the linear carbons are present in an amount of from about 80% to about 99% of the wax and have a number average molecular weight of from about 505 to about 530.

In other embodiments, a toner of the present disclosure may include a core and a shell, the core including a first non-crosslinked polymer such as styrenes, acrylates, methacrylates, butadienes, isoprenes, acrylic acids, methacrylic acids, acrylonitriles, and combinations thereof, in combination with a crosslinked polymer, at least one modified paraffin wax possessing branched carbons in combination with linear carbons, and an optional colorant, wherein the shell includes a second non-crosslinked polymer such as styrenes, acrylates, methacrylates, butadienes, isoprenes, acrylic acids, methacrylic acids, acrylonitriles, and combinations thereof, present in an amount of from about 26 percent by weight of the toner to about 36 percent by weight of the toner, wherein the branched carbons are present in an amount of from about 1% to about 20% of the wax and have a number average molecular weight of from about 520 to about 600, and the linear carbons are present in an amount of from about 80% to about 99% of the wax and have a number average molecular weight of from about 505 to about 530, and wherein particles including the toner possess a circularity of from about 0.950 to about 0.998.

A process of the present disclosure may include, in embodiments, contacting an emulsion including a first non-crosslinked polymer in combination with a crosslinked polymer, at least one modified paraffin wax possessing branched carbons in combination with linear carbons, and an optional colorant; aggregating the particles by contacting the particles with from about 0.1 parts per hundred to about 0.25 parts per hundred of an aggregating agent to form aggregated particles; forming a shell over the aggregated particles by contacting the aggregated particles with an emulsion including a second non-crosslinked polymer; and recovering the toner particles, wherein the toner particles possess a circularity of from about 0.900 to about 0.999.

BRIEF DESCRIPTION OF THE DRAWINGS

Various embodiments of the present disclosure will be described herein below with reference to the figure wherein.

DETAILED DESCRIPTION OF EMBODIMENTS

Figure 1A:
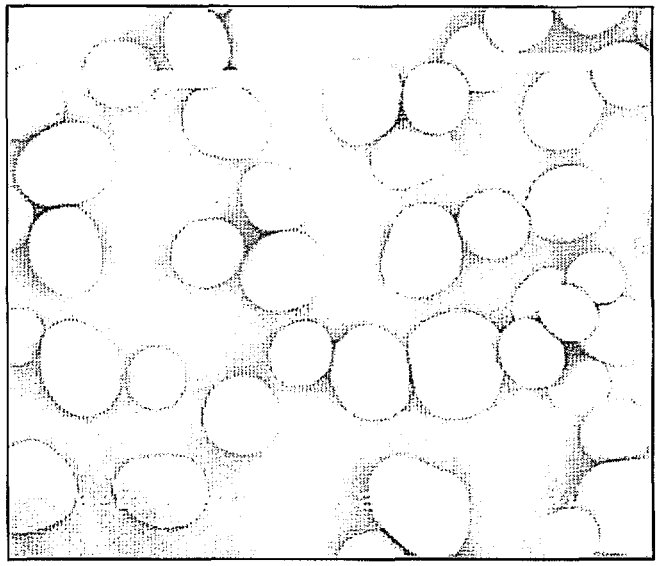
FIGS. 1A-1D are scanning electron microscope (SEM) pictures of particles making up a latex polymer produced in accordance with the present disclosure.

The present disclosure provides toners and processes for the preparation of toner particles. In embodiments, toners of the present disclosure may be prepared by combining a latex polymer, a wax, an optional colorant, and other optional additives. While the latex polymer may be prepared by any method within the purview of those skilled in the art, in embodiments the latex polymer may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 microns to about 15 microns.

Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex polymer. The glass transition temperature of this latex, which in embodiments may be used to form a toner of the present disclosure, may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the polymer to form a latex dispersion can be ionic or nonionic surfactants in an amount to provide a dispersion of from about 0.01 to about 15 weight percent solids, in embodiments of from about 0.1 to about 10 weight percent solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., DOWFAX™ obtained from Dow Chemical, combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA210™, IGEPAL CA-520™, IGEPAL CA720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

Gel Latex

In embodiments, a gel latex may be added to the non-crosslinked latex resin suspended in the surfactant. As used herein a gel latex may refer to, in embodiments, a crosslinked resin or polymer, or mixtures thereof, or a non-crosslinked resin as described above, that has been subjected to crosslinking.

The gel latex may include submicron crosslinked resin particles having a size of from about 10 to about 200 nanometers in volume average diameter, in embodiments from about 20 to 100 nanometers in volume average diameter. The gel latex may be suspended in an aqueous phase of water containing a surfactant, wherein the surfactant can be in an amount from about 0.5 to about 5 percent by weight of total solids, or from about 0.7 to about 2 percent by weight of total solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 to about 25 percent by weight of the crosslinked resin, or from about 0.5 to about 15 percent by weight of the crosslinked resin.

The crosslinked resin particles may be present in an amount of from about 1 to about 20 percent by weight of the toner, in embodiments from about 4 to about 15 percent by weight of the toner, in embodiments from about 5 to about 14 percent by weight of the toner.

In embodiments, the resin utilized to form the toner may be a mixture of a gel resin and a non-crosslinked resin.

Functional Monomers

In embodiments, it may be advantageous to include a functional monomer when forming a latex polymer and the particles making up the polymer. Suitable functional monomers include monomers having carboxylic acid functionality. Such functional monomers may be of the following formula (I):

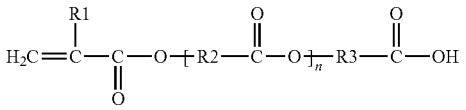

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such functional monomers include beta carboxyethyl acrylate (β-CEA), poly(2-carboxyethyl)acrylate, 2-carboxyethyl methacrylate, combinations thereof, and the like. Other functional monomers which may be utilized include, for example, acrylic acid and its derivatives.

In embodiments, the functional monomer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the functional monomer having carboxylic acid functionality, in embodiments from about 0.5 to about 5 percent by weight of the functional monomer having carboxylic acid functionality.

Where present, the functional monomer may be added in amounts from about 0.01 to about 5 percent by weight of the toner, in embodiments from about 0.05 to about 2 percent by weight of the toner.

Additional functional monomers that may be utilized in the toner formulation processes include bases such as metal hydroxides, including sodium hydroxide, potassium hydroxide, ammonium hydroxide, and optionally combinations thereof. Also useful as a functional monomer are carbonates including sodium carbonate, sodium bicarbonate, calcium carbonate, potassium carbonate, ammonium carbonate, combinations thereof, and the like. In other embodiments, a functional monomer may include a composition containing sodium silicate dissolved in sodium hydroxide.

Reaction Conditions

In the emulsion polymerization process, the reactants may be added to a suitable reactor, such as a mixing vessel. The appropriate amount of at least two monomers, in embodiments from about two to about ten monomers, surfactant(s), functional monomer, if any, initiator, if any, chain transfer agent, if any, colorant, if any, and the like, may be combined in the reactor and the emulsion polymerization process may be allowed to begin. Reaction conditions selected for effecting the emulsion polymerization include temperatures of, for example, from about 45° C. to about 120° C., in embodiments from about 60° C. to about 90° C.

Polymerization may occur until nanometer size particles may be formed, from about 50 nm to about 800 nm in volume average diameter, in embodiments from about 100 nm to about 400 nm in volume average diameter, as determined, for example, by a Brookhaven nanosize particle analyzer.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax

Wax dispersions may also be added during formation of a toner particle in an emulsion aggregation process. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

In embodiments, a suitable wax may include a paraffin wax. Suitable paraffin waxes include, for example, paraffin waxes possessing modified crystalline structures, which may be referred to herein, in embodiments, as a modified paraffin wax. Thus, compared with conventional paraffin waxes, which may have a symmetrical distribution of linear carbons and branched carbons, the modified paraffin waxes of the present disclosure may possess branched carbons in an amount of from about 1% to about 20% of the wax, in embodiments from about 8% to about 16% of the wax, with linear carbons present in an in amount of from about 80% to about 99% of the wax, in embodiments from about 84% to about 92% of the wax.

In addition, the isomers, i.e., branched carbons, present in such modified paraffin waxes may have a number average molecular weight (Mn), of from about 520 to about 600, in embodiments from about 550 to about 570, in embodiments about 560. The linear carbons, sometimes referred to herein, in embodiments, as normals, present in such waxes may have a Mn of from about 505 to about 530, in embodiments from about 512 to about 525, in embodiments about 518. The weight average molecular weight (Mw) of the branched carbons in the modified paraffin waxes may be from about 530 to about 580, in embodiments from about 555 to about 575, and the Mw of the linear carbons in the modified paraffin waxes may be from about 480 to about 550, in embodiments from about 515 to about 535.

For the branched carbons, the weight average molecular weight (Mw) of the modified paraffin waxes may demonstrate a number of carbon atoms of from about 31 to about 59 carbon atoms, in embodiments from about 34 to about 50 carbon atoms, with a peak at about 41 carbon atoms, and for the linear carbons, the Mw may demonstrate a number of carbon atoms of from about 24 to about 54 carbon atoms, in embodiments from about 30 to about 50 carbon atoms, with a peak at about 36 carbon atoms.

The modified paraffin wax may be present in an amount of from about 2% by weight to about 20% by weight of the toner, in embodiments from about from about 4% by weight to about 15% by weight of the toner, in embodiments about 5% by weight to about 13% by weight of the toner.

A benefit of the present disclosure includes the smoothness obtained with particles formed with these waxes, and that the wax does not migrate to the particle surface.

Colorants

A colorant dispersion may be added to the latex particles and wax. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP604™, NP608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido) phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 (sometimes referred to herein, in embodiments, as PB 15:3 cyan pigment) having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade.

Shell

In embodiments, while not required, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 9 microns. In other embodiments, the toner particles may be prepared by in-situ seeded semi-continuous emulsion copolymerization of the latex with the addition of the shell latex once aggregated particles have formed.

Where present, the shell latex may be present in an amount of from about 20 to about 40 percent by weight of the dry toner particle, in embodiments from about 26 to about 36 percent by weight of the dry toner particle, in embodiments about 27 to about 34 percent by weight of the dry toner particle.

Aggregating Agents

In embodiments, an aggregating agent may be added during or prior to aggregating the latex and the aqueous colorant dispersion.

Examples of suitable aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. In embodiments, suitable aggregating agents include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid.

In embodiments, a suitable aggregating agent includes PAC, which is commercially available and can be prepared by the controlled hydrolysis of aluminum chloride with sodium hydroxide.

Suitable amounts of aggregating agent may be from about 0.1 parts per hundred (pph) to about 0.25 pph, in embodiments from about 0.12 pph to about 0.20 pph.

The resulting blend of latex, optionally in a dispersion, optional colorant dispersion, wax, and aggregating agent, may then be stirred and heated to a temperature near the Tg of the latex, in embodiments from about 30° C. to about 70° C., in embodiments of from about 40° C. to about 65° C., resulting in toner aggregates of from about 3 microns to about 15 microns in volume average diameter, in embodiments of from about 5 microns to about 9 microns in volume average diameter.

Once the desired final size of the toner particles is achieved, the pH of the mixture may be adjusted with a base to a value of from about 3.5 to about 7, in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, optional colorant, and wax may be subsequently coalesced. Coalescing may include stirring and heating at a temperature of from about 80° C. to about 99° C., in embodiments from about 85° C. to about 98° C., resulting in a toner shape, sometimes referred to herein, in embodiments, as circularity, of from about 0.900 to about 0.999, in embodiments of from about 0.950 to about 0.998, in embodiments of from about 0.970 to about 0.995.

Coalescing may be accelerated by adjusting the pH of the mixture to less than 6 with, for example, an acid to coalesce the toner aggregates.

Once the desired shape of the toner particles is achieved, the pH of the mixture may be adjusted with a base to a value of less than 9.

The mixture may then be cooled in a cooling or freezing step to less than Tg of the particle.

The toner slurry may then be washed to remove surfactants.

Particles are then dried so that they have a moisture level below 1%.

Particles of the present disclosure may have a desirable surface area for use as toner. Surface area may be determined in embodiments, by the Brunauer, Emmett and Teller (BET) method. BET surface area of a sphere can be calculated by the following equation:

$$\text{Surface Area } (m^2/g) = 6/(\text{Particle Diameter (um)} * \text{Density (g/cc)}).$$

Toner particles may have a surface area of from about 0.5 $m^2/g$ to about 1.4 $m^2/g$, in embodiments from about 0.6 $m^2/g$ to about 1.2 $m^2/g$, in some embodiments from about 0.7 $m^2/g$ to about 1.0 $m^2/g$.

In embodiments, toners of the present disclosure may have a triboelectric charge of from about −10 μC/g to about −60 μC/g, in embodiments from about −20 μC/g to about −50 μC/g. Toners of the present disclosure may also possess a parent toner charge per mass ratio (Q/M) of from about −3 μC/g to about −35 μC/g, and a final toner charging after surface additive blending of from −10 μC/g to about −45 μC/g.

Additives

Further optional additives which may be combined with a toner include any additive to enhance the properties of toner compositions. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like.

Other additives which may be combined with a toner composition of the present disclosure include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments from about 6.5 microns to about 8 microns. Toner particles of the present disclosure may have a circularity of from about 0.900 to about 0.999, in embodiments from about 0.950 to about 0.998, in some embodiments from about 0.970 to about 0.995.

Following the methods of the present disclosure, toner particles may be obtained having several advantages compared with conventional toners: (1) increase in the robustness of the particles' triboelectric charging due, in part, to reduced wax at the surface of the particles, which reduces toner defects and improves machine performance, including improved flow and low cohesion; (2) easy to implement, no major changes to existing aggregation/coalescence processes; and (3) increase in productivity and reduction in unit manufacturing cost (UMC) by reducing the production time and the need for rework (quality yield improvement due, at least in part, to the reproducible nature of the process).

Toners of the present disclosure have excellent properties including hot offset, fusing ratio, and density. For example, toners of the present disclosure may possess hot offset temperatures, i.e., temperatures at which images produced with the toner may become fixed to a substrate, of from about 135° C. to about 220° C., in embodiments from about 155° C. to about 200° C. The fusing ratio of an image may be evaluated in the following manner. First, a status A density (OD1) corresponding to each color of an image is measured, and then an adhesive tape is adhered to the image. Thereafter, the adhesive tape is peeled off, and then a status A density (OD2) corresponding to each color of the image is measured. The optical density is measured with a spectrometer (for example, a 938 Spectrodentitometer, manufactured by X-Rite). Then, the optical densities thus determined are used to calculate the fusing ratio according to the following Equation.

$$\text{Fusing ratio } (\%) = \frac{OD2}{OD1} \times 100$$

Toners of the present disclosure may thus exhibit a fusing ratio of from about 0.5 to about 1, in embodiments from about 0.6 to about 0.9.

By optimizing the particle size of the particles, in some cases from about 6.5 microns to about 7.7 microns, toners of the present disclosure may be especially suited for bladeless cleaning systems, i.e., single component development (SCD) systems. With a proper sphericity, the toners of the present disclosure may assist in optimized machine performance.

By utilizing the N-539 wax, the surface wax is very low or nonexistent, wax globules are formed below the surface of the particle enabling a very smooth surface and very round particle. This enables good flow characteristics and low cartridge torque values.

Uses

Toners in accordance with the present disclosure can be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Toners were prepared using a 10 liter Henschel blender. The amount of gel and wax was optimized to avoid issues in hot offset and fusing ratio. The general formulation is summarized below in Table 1. Water was added so that the reactor had a solids content of about 14%. The target properties of the toner are summarized below in Table 2.

TABLE 1

| Raw material | Parts |
|---|---|
| Core latex (styrene/butyl acrylate) | 11.8 |
| Shell latex (styrene/butyl acrylate) | 8.79 |
| Gel latex (crosslinked styrene/butyl acrylate) | 3.52 |
| Regal 330 (carbon black pigment) | 2.77 |
| Pigment Blue 15:3 (cyan pigment) | 0.71 |
| Paraffin wax dispersion | 4.51 |
| Polyaluminum chloride (PAC) | 0.187 |
| .02M $HNO_3$ | 1.683 |
| Reactor deionized $H_2O$ | 25.7 |
| Rinse deionized $H_2O$ | 4.0 |

TABLE 2

| Targets | |
|---|---|
| Process or Material Response | Target |
| Particle Size, Volume median (both final slurry and dry particle) | about 7.2 μm |
| Circularity, (final slurry and dry particle) Sysmex 3000 | >0.990 |

The optimized formulation was found to be about 8% gel, about 10-12% wax, 3-4% carbon black, 1% cyan pigment using a latex resin having a particle size of about 231 nm, at about 14% solids and about 32% in the shell. The optimal formulation is summarized below in Table 3.

TABLE 3

| | % of dry toner particle |
|---|---|
| Toner | 100 |
| Bulk Resin | 43.00 |
| Shell Resin | 32.00 |
| Gel Latex | 8.00 |
| Regal 330 | 4.00 |
| PB 15:3 | 1.00 |
| Paraffin wax | 12.00 |

This formulation was found to assist in making the toner particles more robust with respect to hot offset (due to the inclusion of wax) and blocking (due to lowered gel content).

Figure 1B:
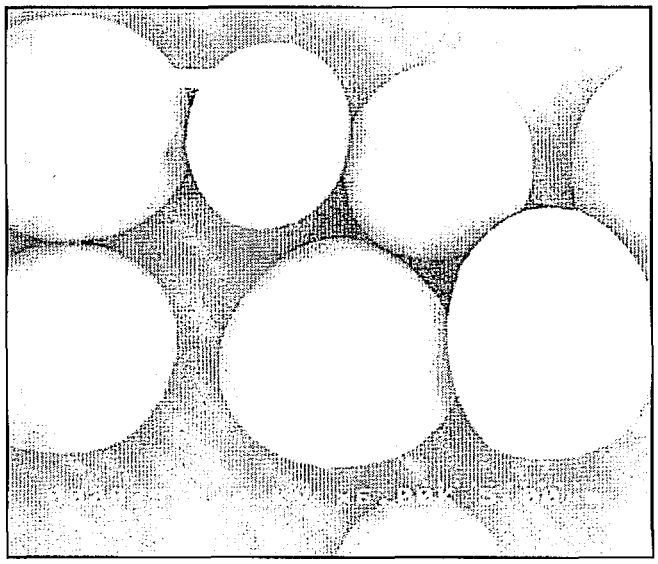
Figure 1C:
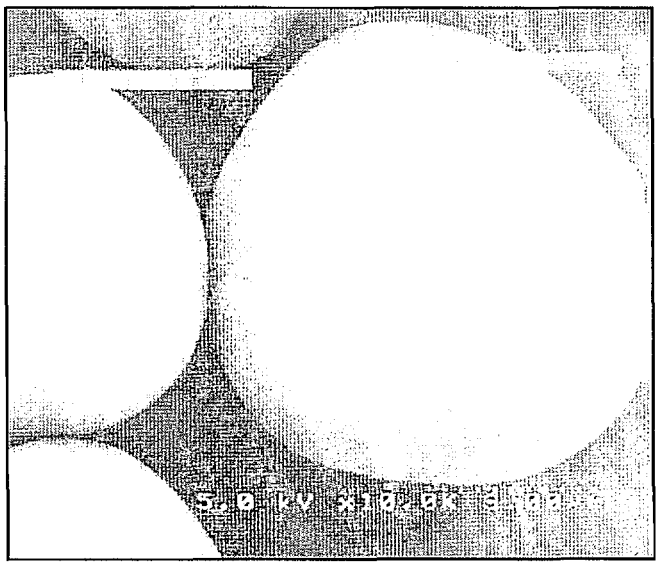
Figure 1D:
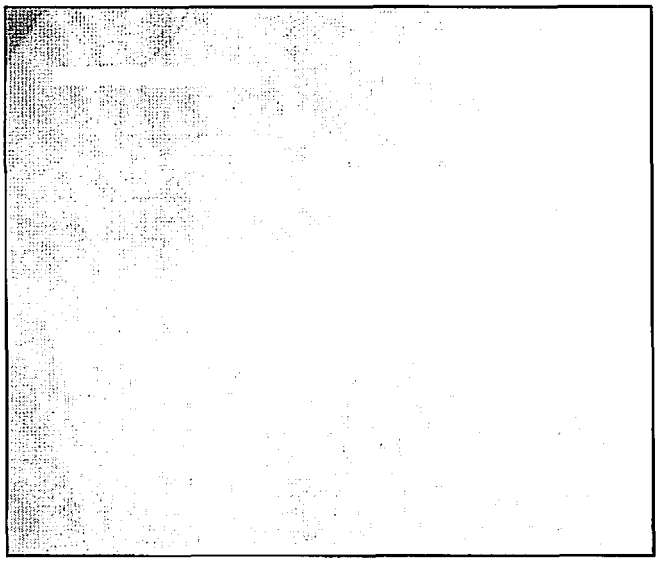
Figure 2A:
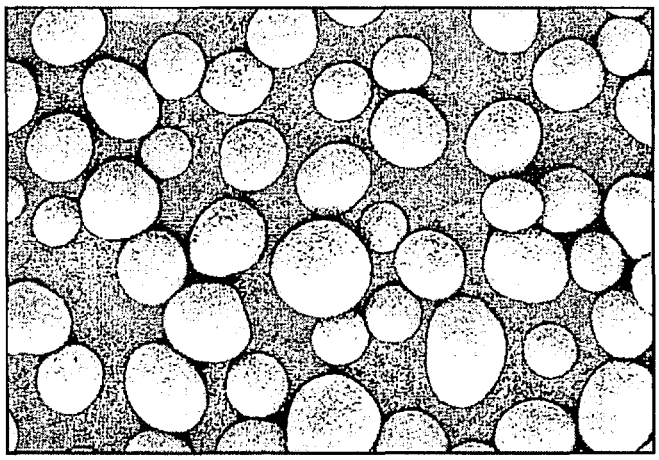
FIGS. 2A-2D are scanning electron microscope (SEM) pictures of toners produced in accordance with the present disclosure.
Figure 2B:
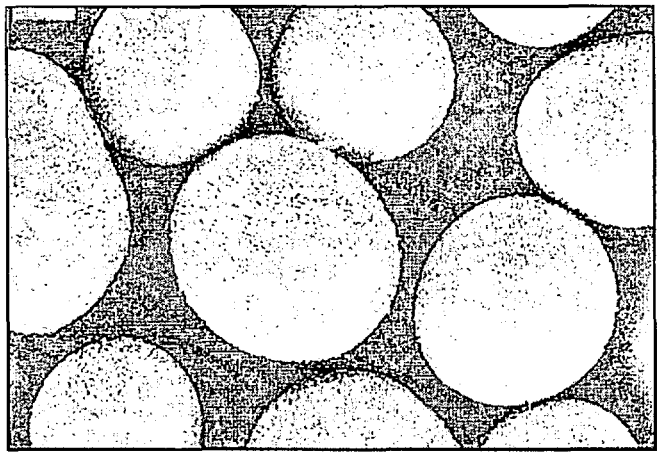
Figure 2C:
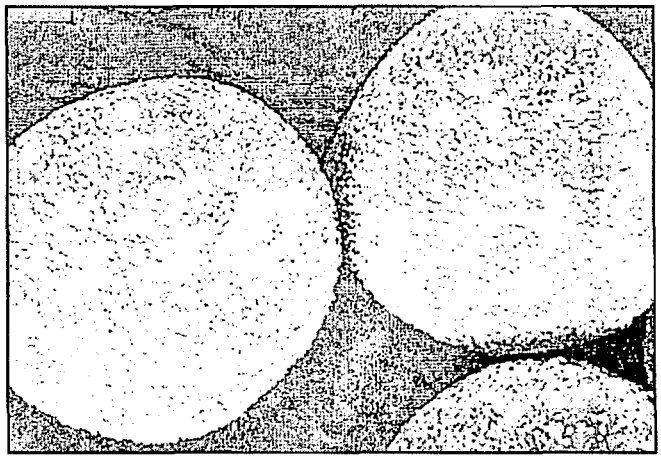
Figure 2D:
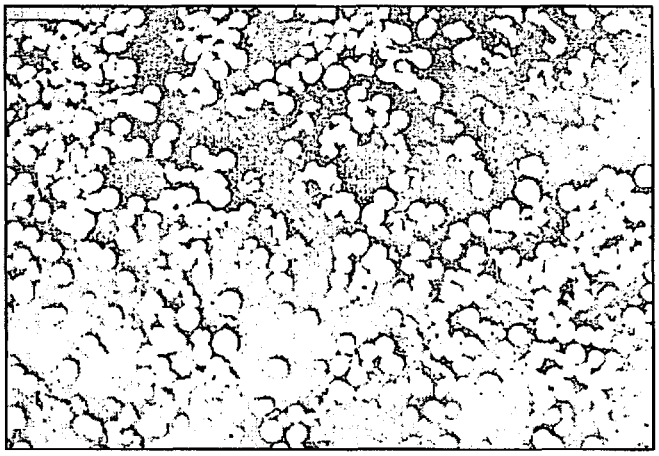

SEM images of the particles of the latex polymer utilized are set forth in FIGS. 1A-1D, and SEM images of the optimal toner formulation of Table 3 are set forth in FIGS. 2A-2D. The images show the high circularity of the toner with the surface completely free of wax. The toner exhibited excellent hot offset performance at about 205° C. and about 215° C.

The fusing ratio of this toner in the B-zone of an electrophotographic device was compared to a commercially available toner. The fusing ratio of a toner of the present disclosure was improved, most noted at 80% being 165° C. compared to the commercially available toner being over 180° C. The lowered fusing ratio for the toner of the present disclosure promoted better image quality and adherence to the substrate.

Particle experiments examining gel and wax content to improve hot offset performance were conducted. It was found that the toner formulations designated 0127 (which is the formulation summarized in Table 3 above), along with the 0151 and 0165 formulations, showed the best performance at low gel and high wax content. These toners also showed good storage stability at 50° C.

The melt flow index (MFI) of the particle was from about 4 to about 15 gm/10 minutes, at about 130° C./10 kg weight, as determined by a Shimatzu CFT500D capillary flow tester. Differential scanning calorimetry (DSC) was utilized to determine the glass transition temperature of the particles, which was found to be from about 45° C. to about 56° C. (open vessel).

Particle experiments examining pigment content to improve toner particle charge were conducted. It was found that the toner formulations with higher cyan/carbon black pigment ratio showed higher charge. In embodiments from about 1:20 to about 1:1.5, in embodiments from about 1:10 to 1:3.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising a core and a shell, wherein the core comprises a resin including a first non-crosslinked polymer in combination with a crosslinked polymer, at least one modified paraffin wax possessing branched carbons in combination with linear carbons, an aggregating agent and an optional colorant, wherein the shell comprises a second non-crosslinked polymer present in an amount of from 20 percent by weight of the toner to 40 percent by weight of the developer, and wherein the branched carbons of the at least one modified paraffin wax are present in an amount of from 1% to 20% of the wax and have a number average molecular weight of from 520 to 600, and the linear carbons are present in an amount of from 80% to 99% of the wax and have a number average molecular weight of from 505 to 530, and wherein the at least one modified paraffin wax does not exhibit symmetrical distribution of linear and branched carbons as compared to a non-modified paraffin wax.

2. The toner of claim 1, wherein the first non-crosslinked polymer, the second non-crosslinked polymer, or both, comprise at least one monomer selected from the group consisting of styrenes, acrylates, methacrylates, butadienes, isoprenes, acrylic acids, methacrylic acids, acrylonitriles, and combinations thereof.

3. The toner of claim 1, wherein the first non-crosslinked polymer, the second non-crosslinked polymer, or both, is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate isoprene), poly(methyl acrylate-isoprene), poly(ethyl acrylate-isoprene), poly(propyl acrylate-isoprene), poly(butyl acrylate-isoprene), poly(styrene-butyl acrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

4. The toner of claim 1, wherein the crosslinked polymer comprises at least one monomer selected from the group consisting of styrenes, acrylates, methacrylates, butadienes, isoprenes, acrylic acids, methacrylic acids, acrylonitriles, and combinations thereof.

5. The toner of claim 1, wherein the optional colorant comprises dyes, pigments, combinations of dyes, combinations of pigments, and combinations of dyes and pigments, and wherein the developer further comprises at least one functional monomer selected from the group consisting of acrylic acid, beta carboxyethyl acrylate, poly(2-carboxyethyl)acrylate, 2-carboxyethyl methacrylate, and combinations thereof.

6. The toner of claim 1, wherein the branched carbons in the modified paraffin wax have a weight average molecular weight of from 530 to 580, the linear carbons in the modified paraffin wax have a weight average molecular weight of from 480 to 550.

7. The toner of claim 1, wherein the branched carbons of the modified paraffin wax have a number of carbon atoms of from 31 to 59, and the linear carbons of the modified paraffin wax have a number of carbon atoms of from 24 to 54.

8. The toner of claim 1, wherein the toner particle possesses a hot offset temperature of from 205° C. to 215° C., a size of from 5 microns to 9 microns, a circularity of from 0.900 to 0.999, and a surface area from 0.5 $m^2/g$ to 1.4 $m^2/g$.

9. The toner of claim 1, further comprising a cyan pigment in combination with a carbon black pigment, at a ratio of cyan:carbon black of from 1:20 to 1:1.5.

10. The toner of claim 1, wherein the developer particles possess a circularity of from 0.900 to 0.999.

11. The developer toner of claim 1, wherein the branched carbons in the modified paraffin wax have a number of carbon atoms of from 31 to 59 and a weight average molecular weight of from 530 to 580, and the linear carbons in the modified paraffin wax have a number of carbon atoms of from 24 to 54 and a weight average molecular weight of from 480 to 550.

12. A toner comprising:

a core and a shell, the core comprising a first non-crosslinked polymer selected from the group consisting of styrenes, acrylates, methacrylates, butadienes, isoprenes, acrylic acids, methacrylic acids, acrylonitriles, and combinations thereof, in combination with a crosslinked polymer, at least one modified paraffin wax possessing branched carbons in combination with linear carbons, an aggregating agent and an optional colorant, wherein the shell comprises a second non-crosslinked polymer selected from the group consisting of styrenes, acrylates, methacrylates, butadienes, isoprenes, acrylic acids, methacrylic acids, acrylonitriles, and combinations thereof, present in an amount of from 26 percent by weight of the toner to 36 percent by weight of the toner, wherein the branched carbons are present in an amount of from 1% to 20% of the wax and have a number average molecular weight of from 520 to 600, and the linear carbons are present in an amount of from 80% to 99% of the wax and have a number average molecular weight of from 505 to 530, wherein particles comprising the toner possess a circularity of from 0.950 to 0.998, wherein particles comprising the toner possess a surface area from 0.5 $m^2/g$ to 1.4 $m^2/g$, and wherein the at least one modified paraffin wax does not exhibit symmetrical distribution of linear and branched carbons as compared to a non-modified paraffin wax.

13. The toner of claim 12, wherein the first non-crosslinked polymer, the second non-crosslinked polymer, or both, comprise at least one monomer selected from the group consisting of styrenes, acrylates, methacrylates, butadienes, isoprenes, acrylic acids, methacrylic acids, acrylonitriles, and combinations thereof, the optional colorant comprises dyes, pigments, combinations of dyes, combinations of pigments, and combinations of dyes and pigments, and wherein the branched carbons in the modified paraffin wax have a weight average molecular weight of from 530 to 580, and the linear carbons in the modified paraffin wax have a weight average molecular weight of from 480 to 550.

14. The toner of claim 12, wherein the branched carbons of the modified paraffin wax have a number of carbon atoms of from 31 to 59, the linear carbons of the modified paraffin wax have a number of carbon atoms of from 24 to 54, and wherein the developer particle possesses a hot offset temperature of from 205° C. to 215° C., and a size of from 5 microns to 9 microns.

15. The toner of claim 12, further comprising a cyan pigment in combination with a carbon black pigment, at a ratio of cyan:carbon black of from 1:20 to 1:1.5.

16. The toner of claim 12, wherein the crosslinked polymer comprises at least one monomer selected from the group consisting of styrenes, acrylates, methacrylates, butadienes, isoprenes, acrylic acids, methacrylic acids, acrylonitriles, and combinations thereof.

* * * * *